United States Patent [19]

Sloot

[11] Patent Number: 4,934,078

[45] Date of Patent: Jun. 19, 1990

[54] PLANAR ERECTABLE PICTURE FRAME

[75] Inventor: Alexander Sloot, Stamford, Conn.

[73] Assignee: Printmark, Inc., Stamford, Conn.

[21] Appl. No.: 272,224

[22] Filed: Nov. 16, 1988

[51] Int. Cl.[5] ..... G09F 1/12

[52] U.S. Cl. ..... 40/152.1; 40/152; 40/154

[58] Field of Search ..... 40/152.1, 124.1, 158.1, 40/159, 154, 155, 156, 591, 610, 152

[56] References Cited

U.S. PATENT DOCUMENTS

| | | | |
|---|---|---|---|
| 792,501 | 6/1905 | Davis . | |
| 1,592,711 | 10/1925 | Acklin . | |
| 2,253,814 | 8/1941 | Sames | 40/159 |
| 2,271,946 | 2/1942 | Miller . | |
| 2,292,744 | 8/1942 | Cross | 40/152.1 |
| 2,419,187 | 4/1947 | Jolly | 40/152 |
| 2,428,242 | 9/1947 | Prost | 40/154 |
| 3,234,676 | 2/1966 | Colicki et al. . | |
| 4,275,517 | 6/1981 | Blanchard . | |
| 4,285,683 | 8/1981 | Cross . | |
| 4,296,561 | 10/1981 | Lawrence | 40/152.1 |
| 4,343,105 | 8/1982 | Isaacson . | |
| 4,379,373 | 4/1983 | Transport . | |
| 4,559,727 | 12/1985 | Lewyt . | |
| 4,622,769 | 11/1986 | Friedman . | |
| 4,685,785 | 8/1987 | Mundt et al. . | |
| 4,777,746 | 10/1988 | Brooks | 40/152.1 |
| 4,780,975 | 11/1988 | Friedman . | |

FOREIGN PATENT DOCUMENTS

| | | | |
|---|---|---|---|
| 1169974 | 6/1959 | France | 40/152.1 |
| 625554 | 6/1949 | United Kingdom | 40/152.1 |

*Primary Examiner*—Kenneth J. Dorner
*Assistant Examiner*—Brian K. Green
*Attorney, Agent, or Firm*—St. Onge Steward Johnston & Reens

[57] ABSTRACT

A planar erectable picture frame is described formed of vinyl materials that are bonded together. A front transparent vinyl sheet bearing an opaque printing to define a window surrounded by an opaque border is placed over an inner layer of cardboard parts. One part is sized to fit under the opaque border while the other parts are so spaced as to define a support stand when folded. A vinyl backing layer is bonded to the front sheet around peripheral borders of the inner layer parts and along borders of the window. In another embodiment, the front sheet is opaque and a transparent vinyl sheet bonded to it at the window. The backing layer is provided with a slit to insert a photo inside the window. The backing layer is formed of a pair of sheets, an outer one of which being provided with slits to retain tabs used to hold the folded out support stand.

11 Claims, 2 Drawing Sheets

PLANAR ERECTABLE PICTURE FRAME

FIELD OF THE INVENTION

This invention generally relates to picture frames and more particularly to picture frames with connected fold-out stands.

BACKGROUND OF THE INVENTION

Calendars with fold-out stands to support the calendar on a desk or the like in a free-standing manner are known in the art. Typically, the calendar has suitable support elements on the backside. These elements fold out from a flat position to form a support stand. Picture frames are known in which a support element is pivotally connected at the back of the frame and is shaped to provide a support stand when the element is folded out.

SUMMARY OF THE INVENTION

In one picture frame in accordance with the invention, a sharp, pleasant appearance is achieved. This is obtained by forming the frame of a multi-layered composite structure held together with bonded vinyl sheet materials. A front sheet is made of a vinyl material that is transparent and bears on a side a printing which is opaque and forms a border around a transparent segment. The border then appears as a frame for a picture that can be inserted behind the transparent segment from the back. In another picture frame in accordance with the invention, an opaque vinyl front sheet is used with a transparent segment that can be made of a separately bonded transparent material.

An inner layer is formed of stiff, segmented sheet material, such as cardboard, that is fully enclosed by welding a backing vinyl layer to the front sheet around peripheral edges of the inner layer segments. As a result, the composite structure has an articulated shape with parts that are connected along fold lines where the inner sheet and backing layer are bonded together.

The backing layer has a slit at a location where a picture can be inserted to fit within the transparent segment. The front sheet and backing layer and the inner layer segments are sized and shaped to form a planar composite structure with parts that can be folded along the fold lines into a support stand. The front sheet and backing layer are further shaped and bonded together to form tabs near an end of the composite structure. The tabs in turn easily slide into slits at the back to hold the shape of the support stand.

As described herein, a second outer layer is provided that covers the first backing sheet. The outer layer sheet has slits that are positioned to easily receive the tabs.

A picture frame in accordance with the invention is particularly suitable for vinyl sheet printing and handling machines in which sheets are cut and welded to each other. The picture frame can be made inexpensively and used for promotions and the like.

It is therefore an object of the invention to provide a picture frame that is formed with vinyl sheet material, is attractive and can be conveniently provided with printed subject matter.

These and other advantages and objects of the invention can be understood from the following description of a preferred embodiment as described in conjunction with the drawings.

DETAILED DESCRIPTION OF DRAWINGS

Figure 1:
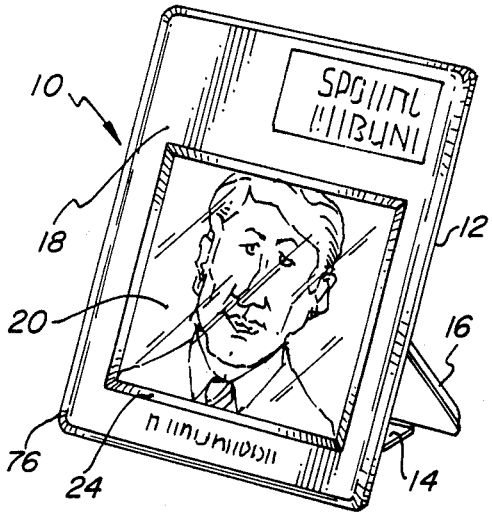
FIG. 1 is a front perspective view of a picture frame in accordance with the invention.
Figure 2:
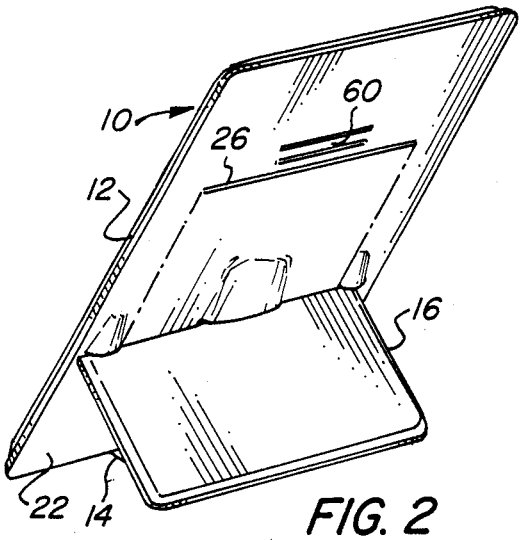
FIG. 2 is a rear perspective view of the picture frame of FIG. 1.

With reference to FIGS. 1 and 2, a picture frame 10 in accordance with the invention is shown in its folded position. Frame 10 includes three separate but articulated segments 12, 14 and 16. The frame 10 includes a front vinyl sheet 18 that is normally transparent and carries an opaque printing on border areas that surround a transparent window 20. Alternatively, the front sheet 18 can be formed of an opaque vinyl sheet with a windowed segment and with a transparent sheet bonded to the front sheet over its windowed segment. A backing vinyl layer 22 is placed on the back of the frame 10 and is bonded, such as by welding or heat fusing, to the front sheet 18 at peripheral edges of segments 12, 14 and 16 along the beveled edges 24 of the window 20. A slit-type opening 26 is formed in backing layer 22 opposite an upper end of window 20 to enable insertion of a picture in window 20 behind the front sheet 18.

Figure 3:
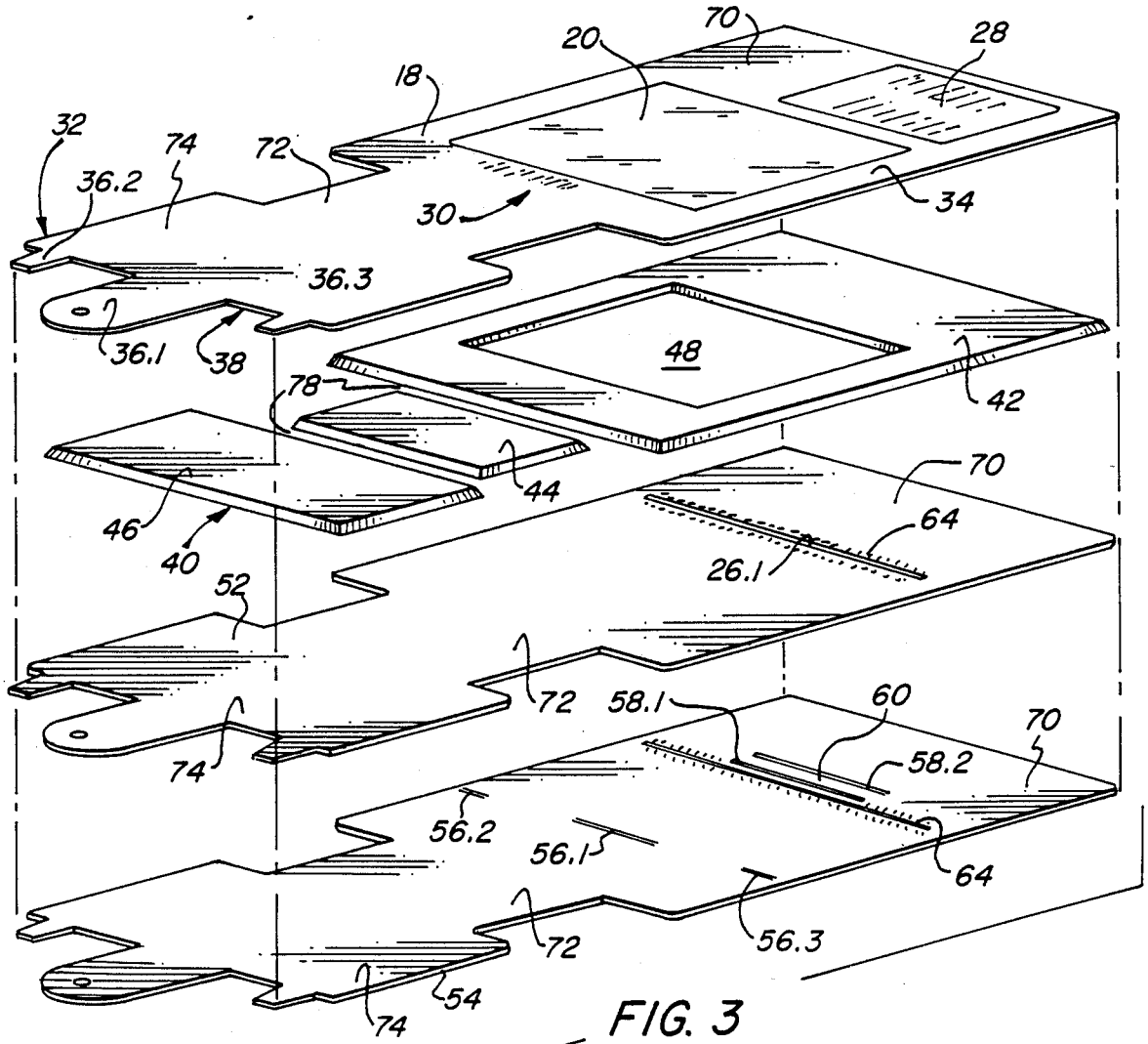
FIG. 3 is a perspective exploded view of a picture frame in accordance with the invention.

A picture frame in accordance with the invention is conveniently formed with vinyl sheet materials that can be printed to and then bonded to each other using known techniques and die cutting machines. FIG. 3 illustrates the various layers employed in the manufacture of picture frame 20. The front sheet 18 is formed by initially printing on transparent vinyl sheet 18 a generally rectangular opaque ink area having an unprinted window 20. Other areas, such as at 28 and 30, may be provided with special indicia, words or graphics in different colors as appears appropriate. The printed vinyl sheet is then cut in a die to a desired shape as shown at 32 in FIG. 3 having an opaque border area 34 around window 20. Sheet 18 further has tab portions 36 extending from end 38 of sheet 18.

An inner layer 40 is provided of a stiff material, such as cardboard, that is cut into separate portions 42, 44 and 46. Portion 42 is intended as a stiffener for the picture segment 12 and carries a window 48 that is commensurately sized with window 20. Portions 44 and 46 serve as rigidizing fillers for the part of picture frame 10 that is folded into a support stand as illustrated in FIGS. 1 and 2. All edges of portions 42, 44 and 46 are beveled including the edges facing window 48.

The backing layer 22 is formed of a pair of vinyl sheets 52, 54 whose sizes and shapes are the same as front sheet 18. Inner sheet 52 has a single slit 26.1 and outer sheet 54 has a plurality of slits such as 56.1, 56.2 and 56.3 to receive tabs. A pair of parallel, spaced-apart slits 58.1 and 58.2 are made to form a strap 60. Slit 26.2 is so located as to be opposite slit 26.1 to form the slit 26 described with reference to FIG. 2.

In the formation of picture frame 10, the sheets 18, 52 and 54 are not first cut to the shapes as illustrated in FIG. 2 but are preferably formed in a rectangular shape with their respective slits. The rectangular form of backing sheets 52 and 54 are aligned so as to place slits 26.1 and 26.2 opposite each other. The sheets 52, 54 are bonded to each other in a narrow seam 64 adjacent slits 26.1 and 26.2 so as to form a single slit 26. The sheets 18, 52, 54 and inner layer parts 42, 44 and 46 are then aligned so as to be respectively opposite panels 70, 72 and 74 of each of sheets 18 and 52.

Figure 4:
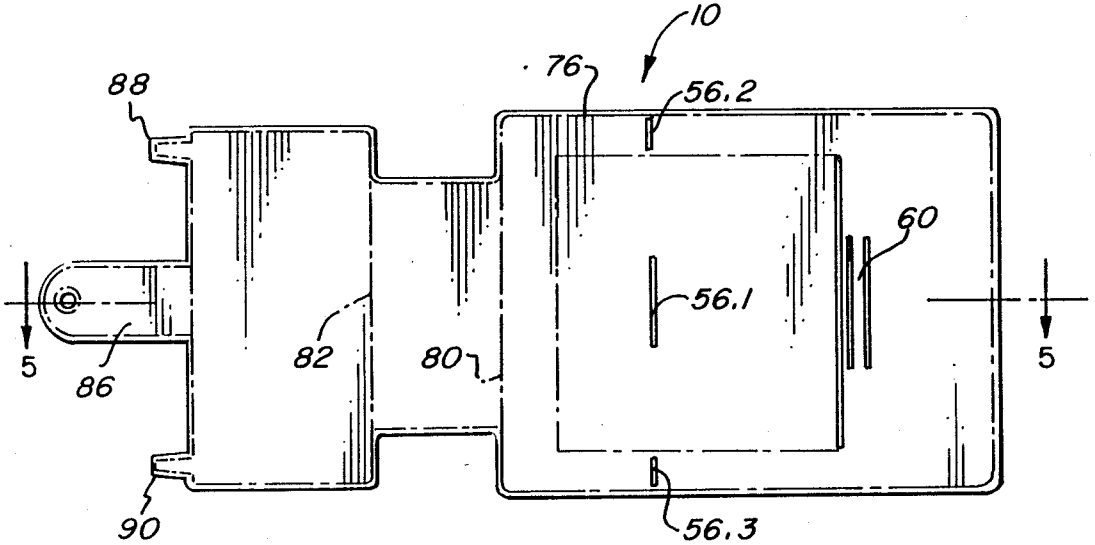
FIG. 4 is a plan view of the unfolded back of the picture frame of this invention.
Figure 5:
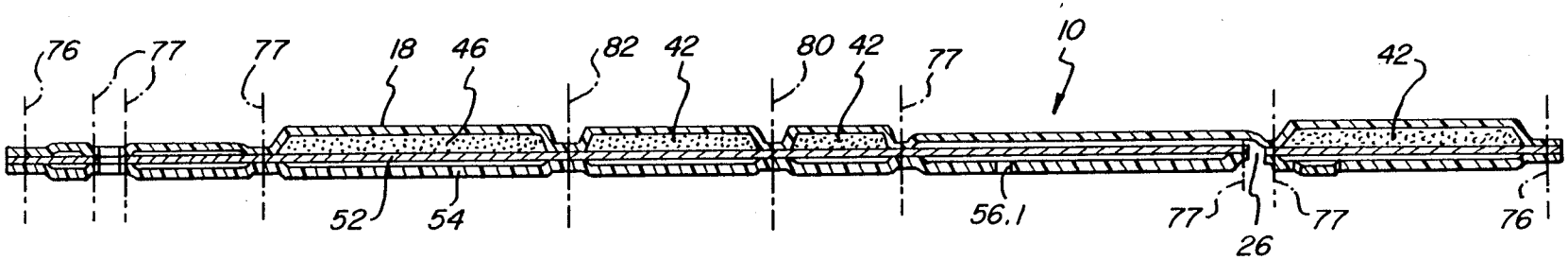
FIG. 5 is an enlarged section view of the picture frame taken along the line 5—5 in FIG. 4.

An appropriate die, having a working shape as defined by the outer shapes of sheets 18, 52 and 54 and the window 20 is then applied to both bond the latter sheets together along a peripheral edge 76 and at areas 77, as shown in FIGS. 4 and 5 and along the beveled edges 24, of window 20 while cutting the rectangular sheets at their outer peripheries. Since parts 42, 44 and 46 are spaced from each other by gaps 78 as illustrated in FIG. 3, the die is appropriately shaped to further bond the vinyl sheets 18, 52 and 54 together along lines 80 and 82 as illustrated in FIGS. 4 and 5 so as to form corresponding fold lines.

The die cutting results in the formation of tabs 86, 88 and 90 that are used to hold the picture frame together after segments 14 and 16 have been folded as shown in FIG. 2. Tabs 86, 88 and 90 easily slide into and remain in slits 56.1, 56.2 and 56.3 beneath outer backing sheet 54 and over inner backing sheet 52.

Figure 6:
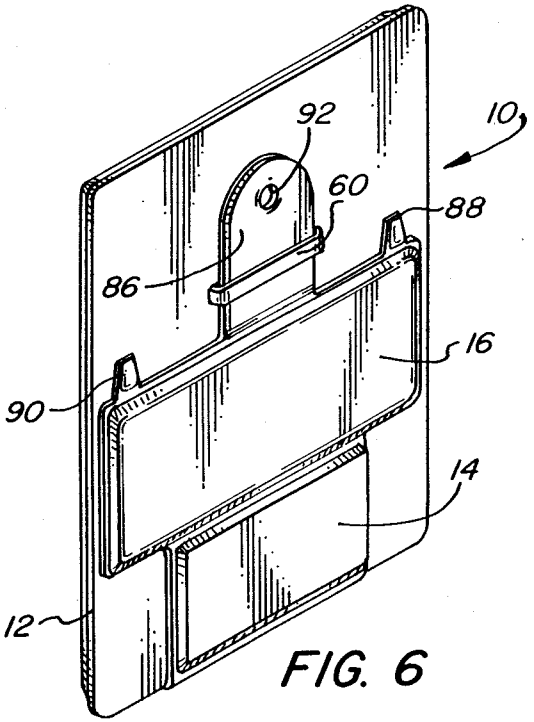
FIG. 6 is a rear perspective view of a picture frame in accordance with the invention but folded into a different shape.

FIG. 6 illustrates another use of picture frame 10. In this case the segments 14 and 16 are folded flush onto backing sheet 22 so that the tab 86 fits beneath strap 60. A hole 92 in the tab 86 and formed during the die cutting operation can then be used to hang the picture frame 10.

Having thus described a picture frame in accordance with the invention, its advantages can be appreciated. Variations from the described embodiment can be made without departing from the scope of the claims.

What is claimed is:

1. A picture frame, comprising:

a multilayered composite structure having, a front sheet of vinyl material having a transparent segment;

an inner layer formed of stiff sheet material, said inner layer having a plurality of separated portions including a picture segment sized to fit beneath the front sheet and rigidizing fillers;

a window in said picture segment;

a backing layer of vinyl sheet material located beneath the inner layer and commensurately sized with the front sheet and being bonded to the front sheet around peripheral edges of the plurality of separated portions of the inner layer to form a composite layer and fold lines between the plurality of separated portions of the inner layer, said fillers being shaped to form a support stand for the picture frame when folded in a predetermined manner along said fold lines;

said backing layer being provided with an opening near the transparent segment at a location selected to enable the insertion of a picture beneath the front sheet and opposite the transparent segment.

2. The picture frame as claimed in claim 1 wherein the backing layer is covered by an outer layer of vinyl sheet material, said outer layer having slits located to enable tabs of the composite structure to fit between the backing and outer layers to maintain the shape of the support stand and having a slit opposite the slit in the backing layer.

3. The picture frame as claimed in claim 2 wherein said outer layer has an upper-located pair of spaced-apart parallel slits to form a retainer strap under which a tab of the composite structure can fit to hang the picture frame therefrom.

4. The picture frame as claimed in claim 1 wherein the fillers of the inner layer have beveled edges around outer peripheral edges and along inner edges bordering the transparent segment.

5. The picture frame as claimed in claim 1 wherein the fillers of the inner layer include a middle filler sized to form a horizontal support and an end filler sized to form an upright rear support.

6. The picture frame as claimed in claim 5 wherein said fillers are formed of cardboard material.

7. The picture frame as claimed in claim 3 wherein said front sheet and backing layer are shaped to form a plurality of end-located tabs, one of said tabs extending past the inner layer for a sufficient distance to pass underneath the strap and form a hang tab for the picture frame.

8. The picture frame as claimed in claim 2 wherein the front sheet, the backing layer and the outer layer are commensurately sized and bonded to each other along peripheral edges.

9. The picture frame as claimed in claim 1 wherein the front sheet is formed of transparent vinyl material and has an opaque ink printed on one side thereof in preselected border areas that surround the transparent segment so as to define a frame.

10. A picture frame, comprising:

a multilayered composite structure having, a front sheet of normally transparent vinyl material having opaque ink printed on one side thereof in preselected border areas that surround a transparent segment so as to define a frame;

an inner layer of stiff sheet material, said inner layer having a plurality of separated portions including a picture segment sized to fit beneath and covered by the opaque preselected border areas of the front sheet and rigidizing fillers;

a window in said picture segment;

a backing layer of vinyl sheet material located beneath the inner layer and commensurately sized with the front sheet and being bonded to the front sheet around peripheral edges of the plurality of separated portions of the inner layer to form a composite layer and fold lines between the plurality of separated portions of the inner layer, said fillers being shaped to form a support stand for the picture when folded in a predetermined manner along said fold lines;

said backing layer being provided with an opening near the transparent segment at a location selected to enable the insertion of a picture beneath the front sheet and opposite the transparent segment.

11. The picture frame as claimed in claim 10 wherein the backing layer is covered by an outer layer of vinyl sheet material, said outer layer having slits located to enable tabs of the composite structure to fit between the backing and outer layers to maintain the shape of the support stand and having a slit opposite the slit in the backing layer.

* * * * *